US005546741A

United States Patent [19]

Karhu

[11] Patent Number: 5,546,741

[45] Date of Patent: Aug. 20, 1996

[54] REVERSE STRANDING APPARATUS AND METHODS

[75] Inventor: Raimo Karhu, Helsinki, Finland

[73] Assignee: Nokia-Maillefer Oy, Vantaa, Finland

[21] Appl. No.: 313,240

[22] PCT Filed: Mar. 30, 1993

[86] PCT No.: PCT/FI93/00127

§ 371 Date: Oct. 3, 1994

§ 102(e) Date: Oct. 3, 1994

[87] PCT Pub. No.: WO93/20566

PCT Pub. Date: Oct. 14, 1993

[30] Foreign Application Priority Data

Apr. 3, 1992 [FI] Finland ..... 921477

[51] Int. Cl.[6] ..... D01H 5/00; D01H 7/46

[52] U.S. Cl. ..... 57/293; 57/314; 57/361

[58] Field of Search ..... 242/418, 418.1; 57/293, 294, 204, 314, 11, 361

[56] References Cited

U.S. PATENT DOCUMENTS

| | | | |
|---|---|---|---|
| 3,823,543 | 7/1974 | Glushko et al. | 57/314 |
| 4,266,399 | 5/1981 | Ellis | 57/293 |
| 4,339,913 | 7/1982 | Vogelsberg | 57/294 |
| 4,365,469 | 12/1982 | Vogelsberg | 57/293 |
| 4,414,802 | 11/1983 | Garner et al. | 57/293 |
| 4,813,223 | 3/1989 | Nipper et al. | 57/6 |
| 4,974,408 | 12/1990 | Karhu | 57/314 |
| 5,102,584 | 4/1992 | Paivinen et al. | 57/297 |
| 5,307,617 | 5/1994 | Karhu | 57/293 |
| 5,315,813 | 5/1994 | Ito et al. | 57/6 |
| 5,355,669 | 10/1994 | Karhu | 57/293 |

*Primary Examiner*—William Stryjewski
*Attorney, Agent, or Firm*—Nixon & Vanderhye

[57] ABSTRACT

The reverse stranding apparatus and method provides elongated elements drawn from supply reels through a divider device, torsion tubes surrounding a central element peripherally and rotatable periodically in opposite directions about the central element and a twisting head rotatable in opposite directions into a nozzle. To achieve a constant pitch and to adjust the tension, the elements are guided to pass about an input capstan before the dividing device and a stranded cable is passed about an output capstan immediately after the nozzle. The input and output capstans are rotated so that the peripheral speeds thereof are constantly higher than the speed of the cable.

14 Claims, 2 Drawing Sheets

FIG. 4
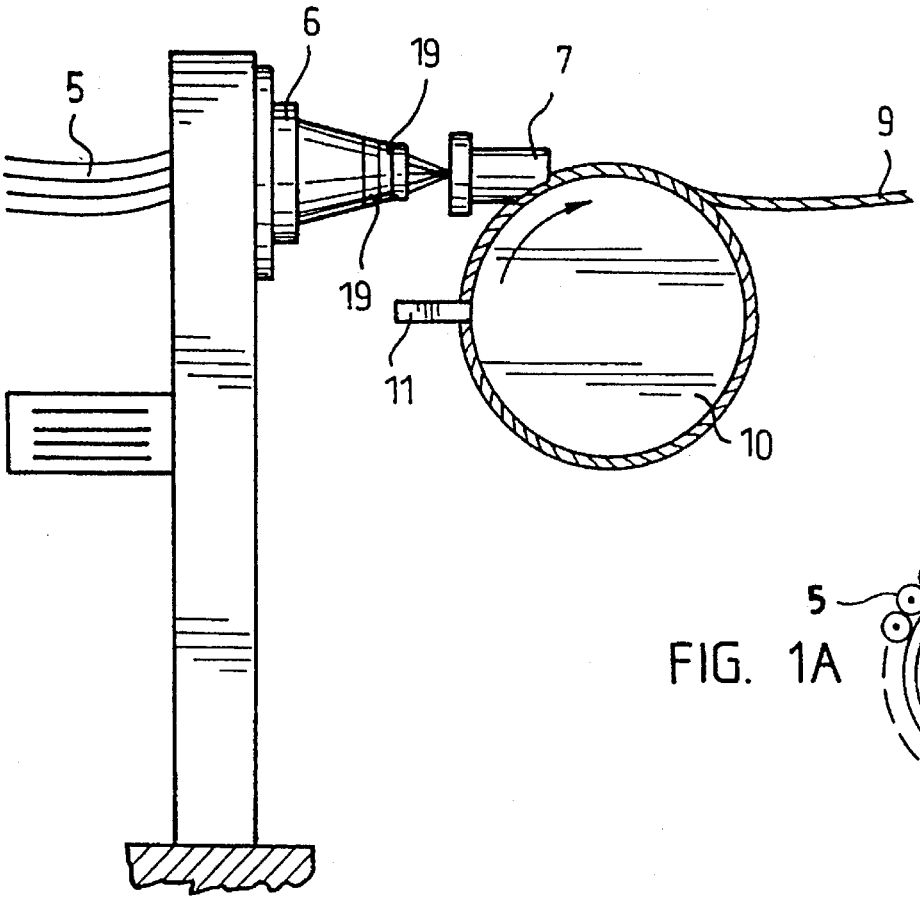
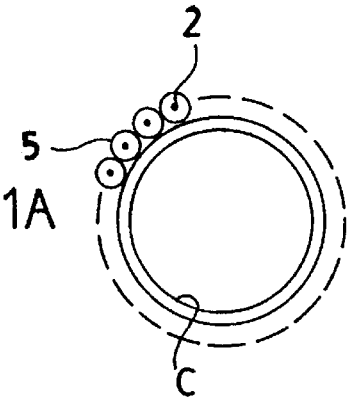
FIG. 1A
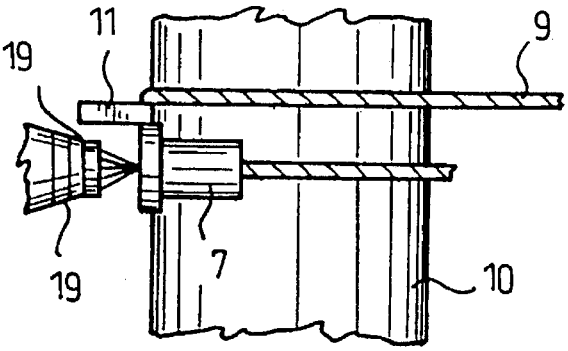
FIG. 5

REVERSE STRANDING APPARATUS AND METHODS

BACKGROUND OF THE INVENTION

The invention relates to a method in connection with reverse stranding, wherein conductors for a cable to be produced, such as wires, groups or blocks, are drawn from supply reels or the like through a divider means, torsion tubes peripherally surrounding a central element and periodically rotatable in opposite directions about the central element, and a twisting head rotatable in opposite directions, into a nozzle or the like.

In traditional reverse stranding, i.e. SZ stranding, conductors are drawn by a suitable drawing apparatus through a stationary divider means and a twisting means rotating periodically in opposite directions into a nozzle, thereafter the conductor is immediately bonded in a bonding device into a reversely stranded product, such as a cable. After the drawing apparatus, the cable is reeled, or the stranded cable is passed to the next production stage. In a traditional reverse stranding apparatus of this type, it is usual to position a tubular intermediate element rotating with the twisting means between the stationary divider means and the rotating twisting means. The intermediate element is attached centrally to the twisting means and mounted at one end rotatably with respect to the stationary divider means.

This traditional arrangement, however, has the disadvantage that the rotation rate of the intermediate element between the divider means and the twisting means is constant, and therefore the twist in the conductors tends to accumulate at the end close to the twisting means. The pitch angle of the conductors thereby gets greater, and the angle deviation of the conductors in the twisting means increases. As a consequence, a greater force is required to draw the conductors, and so the stranded conductors tend to untwist.

Several different solutions have been suggested to the above problem. FI Patent Specification 78576, corresponding to U.S. Pat. No. 4,974,408, for instance, discloses one prior art solution.

The solution disclosed in FI Patent Specification 78576 works well in practice although it has certain disadvantages. A problem with the SZ twisting is that the friction increases with the twisting angle of the oscillating divider plate, and so the tension caused in the wires, conductors, groups or blocks varies. As a result, the pitch length varies, and locking at the direction reversion point becomes more difficult to carry out. This is significant particularly with telecommunication cables as the interference tolerance of the group increases with the degree of symmetry of the pair or quad. Such interferences include cross-talk, external interferences, etc. Wires are subjected to jerks already when they are unwound from the supply reels. Each bending over the idler wheels increases the tension of the wires. The tension of the wires varies within a wide range especially when unreeling "over the flange". Before the grouping or stranding means, the tension of each wire is different, and it cannot be levelled out by the brakes provided at the inlet end. The friction increases with the twisting angle in the tube packet of the SZ torsion tube stranding means, and at the same time the tube packet gets shorter. In addition to the variation in tension, there occurs variation in the speed of the wires. For locking the stranding, a pitch shorter than the nominal pitch is used on both sides of the reversion point. This is called edge acceleration. The shortness of the locking pitch and the number of turns used, i.e. the effective length, determine the magnitude of the speed variations acting on the wires between the twisting head and the supply reels. This factor is particularly apparent after the stranding point. At the direction reversion point, i.e. at the edge acceleration stage, an extra wire length is instantaneously needed at the stranding point. Extra length is obtained from the supply side as well as from the side of the finished group. The attempt to obtain extra wire length after the stranding point results in the occurrence of slipping on the capstan and in a pumping effect acting on the finished group between the grouping means and the standing means. This can be seen from the fact that the lengths of the grouping or stranding pitches vary continuously, thus deteriorating the properties of the cable.

Sheathing lines usually employ a cable stranded helically at a separate production stage. In the sheathing process, tension is exerted on the cable by means of two belt drawing devices, one of which is positioned before the press and acts as a braking and/or drawing means while the other acts as a primary drawing means and is positioned at the terminal end of the line. The cable tension used in this kind of system is too high for SZ stranded cables. Excessive tension opens the direction reversion points in the SZ stranded cable and, in the worst case, straightens all individual conductors. In the torsion tube SZ stranding, the friction exerted on the conductors varies with the twisting angle of the tube packet, being at the greatest at the direction reversion point. This causes tension peaks tending to untwist the SZ stranded cable before the sheathing press. In various SZ stranding point locking systems, such tension variations cause stranding errors, or these systems can be applied only within a very limited operating range. By special arrangements, such as by stranding between the belts of the brake drawing device, passable results can be obtained. The tension of the cable is adjusted by guiding the brake drawing device by a suitable device, such as a so-called dancer. Many solutions of this type are known in the art, but a feature common to all of them is that they are complicated and provide unsatisfactory results.

The object of the invention is to provide a method and an arrangement by means of which the disadvantages of the prior art technique can be eliminated. This is achieved by means of a method according to the invention which is characterized in that the conductors are guided so as to pass about an input capstan before the divider means; that a stranded group, strand or cable is passed about an output capstan immediately after the nozzle; and the input capstan and the output capstan are rotated so that the peripheral speeds thereof are constantly higher than the speed of the wires, groups, strand or cable. The arrangement according to the invention, in turn, is characterized in that it comprises an input capstan which is positioned before the divider means and about which the conductors are arranged to pass; and an output capstan which is positioned immediately after the nozzle or the like and about which the stranded group, strand or cable is arranged to pass; and that the input capstan and the output capstan are arranged to be rotated so that The peripheral speeds thereof are constantly higher than the speed of the wires, groups, strand or cable.

An advantage of the invention is that it enables the pitch lengths to be maintained at the preset values during the SZ stranding or grouping. The tension exerted on the cable, groups or conductors after the apparatus is negligible. The shape of the direction reversion point can be adjusted by edge acceleration. Variation in the pitch length during the grouping is less than 2% when the rotation rate of the twisting head and the line speed are constant. In an apparatus for stranding telecommunication cables, two SZ torsion tube stranding machines can be arranged in succession so that the first produces the pairs or quads while the second strands them together. After each production stage, substantially all of the tension acting on the wires, conductors or groups is removed. Due to the high symmetry of the group, the electrical values of finished telecommunication cables will be excellent. The telecommunication cables will also be of high quality as the method does not cause the wires or conductors to be stretched nor does it damage the insulation at any stage. A further advantage of the invention is that it is advantageous in price as only the primary drawing device is required in the sheathing line in place of the expensive brake belt drawing device and associated guiding means. The stranding and sheathing speeds can be increased to hundreds of meters per minute without any detrimental effects on the stranding process. No straight parts are required at the direction reversion points of the stranding process, but these parts are curved. The combined effect of the nozzle and the capstan eliminates any tension peaks created in the cable stranding. The magnitude of the tension can be controlled by adjusting the slip between the cable and the capstan. The constant braking force exerted on the cable may also be increased and decreased in an advantageous manner. Tension variations can also be levelled out after the capstan even though the friction exerted on the conductors increases with the twisting angle of the tube packet, being at the greatest at the direction reversion point.

BRIEF DESCRIPTION OF THE DRAWING FIGURES

In the following the invention will be described in more detail by means of the preferred embodiments shown in the attached drawings, in which FIG. 1 is a schematic side view of one embodiment of the arrangement according to the invention;

FIG. 4 is an enlarged view of an output capstan of the embodiment shown in FIG. 3; and FIG. 5 is a top view of the output capstan shown in FIG. 4.

Figure 1:
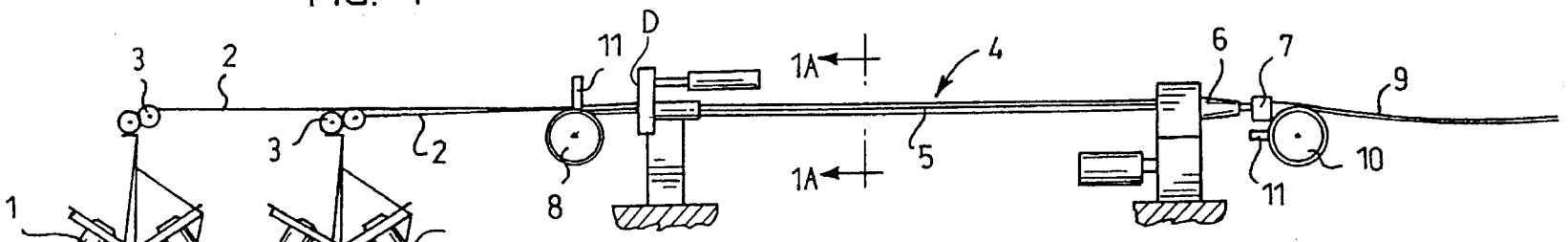
FIG. 1A is a cross-sectional view taken generally about on line 1A—1A in FIG. 1.

FIG. 1 shows one embodiment of the arrangement according to the invention. In FIG. 1, the reference numeral 1 indicates supply reels from which elongated elements, such as wires or conductors 2 are passed via idler wheels 3 to a torsion tube stranding means 4. The wires 2 are passed via a divider means D into and through torsion tubes 5 of the torsion tube stranding means 4 and a twisting head 6 rotatable periodically in opposite directions into a nozzle 7 or the like. The torsion tubes 5 are positioned between the divider means D and the twisting head 6 for turning movement with the twisting head. The torsion tubes 15 are also located about a central element C as illustrated in FIG. 1A. The structure and operation of the torsion tube stranding means are apparent to one skilled in the art, and further description thereof is not believed necessary. See, for example, so they will not be described more the above-mentioned U.S. Pat. No. 4,974,408.

According to the basic invention, the conductors 2 are passed about an input capstan 8 before the divider means. A stranded group, strand or cable 9 is passed about an output capstan 10 immediately after the nozzle 7. The input capstan and the output capstan are rotated so that their peripheral speeds are constantly higher than the speed of the wires, groups, strand or cable. The difference between the speeds means that there occurs slipping between the capstans and the wires or the cable passing about the capstans.

The input capstan 8 is a kind of drawing device which minimizes tensions and levels out tension differences between the different conductors 2, irrespective of the position of the supply reels 1. Due to the input capstan 8, the conductors entering the torsion tubes 5 are equal in tension, the tension values being close to zero.

The conductors 2 are passed from the input capstan 8 through the tubes 5 of the tube packet of the torsion tube stranding means 4 to a twisting head 6 by means of which the conductors are grouped or stranded into the nozzle 7 or the like, i.e. into the stranding nozzle. The nozzle or the like is positioned as close to the shell surface of the output capstan 10 as possible. The stranded group, strand or cable 9 is passed from the nozzle 7 onto the shell surface of the output capstan, and wound about the output capstan at least once. The stranded windings on the surface of the capstan are forced sidewards e.g. by means of a separator pin 11 or the like so that they will not be positioned on top of each other.

At a certain line speed the speed of movement of the group has to be constant both at the stranding point and after it, i.e. the slipping has to be even, in order that the pitch length can be maintained at the preset value. The stranding pitch is the line speed divided by the speed of rotation of the twisting head. The speed of rotation of the twisting head remains within the tolerances given by the motor manufacturer so that incoming wires or conductors have to be able to react to rapid speed variations. When using the invention the wires or conductors react rapidly, and so the pitch remains constant. A rapid reaction is achieved by means of a speed difference between the input and output capstans as the operation of the capstans is based on slippage between the wires, conductors, groups or strand and the shell surface of the capstan. The peripheral speed of the capstan is always higher than the speed of the wires, conductors, groups or strand.

The influence of tension variations in the wires or conductors after the twisting head can be eliminated by rotating the output capstan so that its peripheral speed is at least 100% higher than the speed of the group, strand or cable wound about the capstan. This arrangement is operative at torsion tube twisting angles presently in use.

Figure 2:
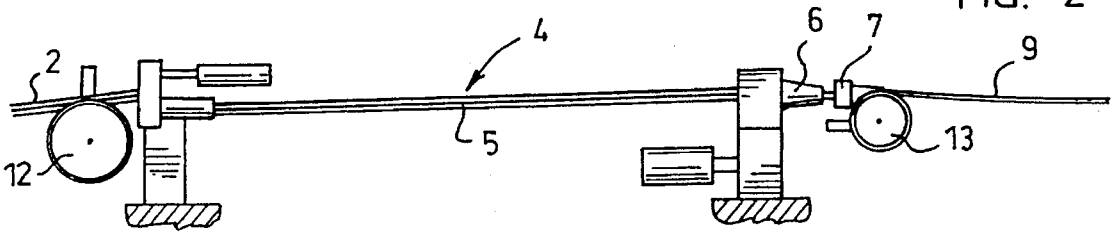
FIG. 2 shows a second embodiment of the arrangement of FIG. 1.

In the edge acceleration, the influence of rapid variations in the speed of the wires or conductors can be eliminated by using a considerably higher speed difference, i.e. slip, in the input capstan than in the output capstan. The peripheral speed of the input capstan has to be at least 20 to 40% higher than that of the output capstan. The wires or conductors thereby react sufficiently rapidly. The higher peripheral speed of the input capstan can be achieved by selecting the diameters of the capstans so that the diameter of the input capstan is greater than that of the output capstan. The speed difference so obtained is constant. This kind of embodiment is shown in FIG. 2, where the torsion tube stranding means, torsion tubes, twisting head, nozzle, wires and cable are indicated by the same reference numerals as in FIG. 1. The input capstan is indicated with the reference numeral 12, and the output capstan with the reference numeral 13. The difference between the peripheral speeds can, of course, also be achieved by varying the rate of rotation of the capstans in a desired manner by means of an appropriate adjustable drive.

Edge acceleration may be replaced by causing the output capstan to slip drastically or by causing the group to slip drastically immediately before the direction reversion point, e.g. by stopping the group for a short period of time. In this way the direction reversion point and the edge acceleration pitches on its both sides will be short. The same effect can be achieved by instantaneously dropping the speed of the capstan, e.g. by stopping the capstan for a short period of time. The terms instantaneously, for a short period of time, etc., refer herein to very short periods of time of the order of a few milliseconds.

Figure 3:
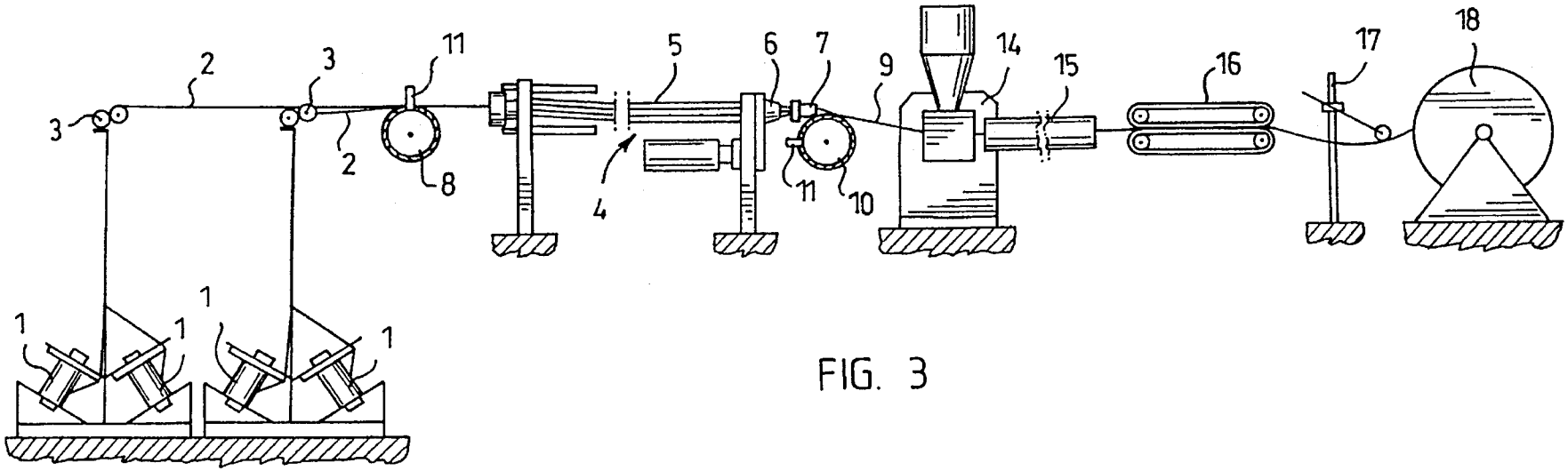
FIG. 3 shows a third embodiment of the arrangement according to the invention.

FIG. 3 shows a simple basic arrangement for a stranding and sheathing line, in which the invention is applied in tension adjustment. Such tension adjustment can also be applied in SZ stranding means of other types. Tension can be adjusted in this manner in wire or conductor grouping machines or in conductors, wire or group stranding machines.

The same reference numerals as in FIG. 1 are used at corresponding points in FIG. 3. In FIG. 3, the reference numeral 14 indicates a sheathing press; the reference numeral 15 indicates a cooling chute; the reference numeral 16 indicates a belt drawing device; the reference numeral 17 indicates a so-called dancer; and the reference numeral 18 indicates a receiving reel.

In the embodiment of FIG. 3, the wires 2 are passed over the idler wheels 3 onto the input capstan 8. After the input capstan 8 the wires or conductors 2 are nearly equal in tension, and they are passed into the torsion tubes 5 of the torsion tube stranding means 4. The stranding point consists of the nozzle 7, into which the wires or conductors 2 are passed from the twisting head 6. The nozzle is of vital importance as the constant braking force exerted on the cable is adjusted in this specific embodiment by varying the distance between the twisting head 6 and the nozzle 7. In the torsion tubes the wires or conductors run in parallel with the line and they are forced into at least two bending angles between the twisting head and the nozzle. The number of the bending angles may also be greater than two. The twisting head may comprise e.g. a number of successive bending rolls or perforated plates 19 of different division diameters. The perforated plates appear clearly from FIGS. 4 and 5.

The nozzle 7 is as close to the shell surface of the output capstan 10 as possible, and the cable 9 is wound about the surface of the output capstan. Friction occurring between the shell surface of the capstan and the cable prevents the strand from untwisting through rotation. The stranded cable may be wound about the output capstan less than once or several times. The different cable windings are guided or forced sidewards by means of a suitable guiding means, such as a separator pin 11 or the like. This appears clearly from FIG. 5.

The tension between the stranding point and the primary drawing device 16 is achieved by adjusting the difference between the peripheral speed of the capstan and the speed of the stranded cable 9, i.e. the slip. A small speed difference provides a greater tension, whereas the tension approaches zero when the speed difference is very large. The difference between the speed of the cable and the peripheral speed of the output capstan 10 can be adjusted in accordance with the twisting angle of the torsion tube packet so that the difference increases with increasing twisting angle. This adjustment of tension can be performed when the speed difference is between 20 and 120%.

Between the stranding point and the twisting head, the cable is usually subjected to the application of a material, such as talc, longitudinal strips, laminates or combinations thereof. After the sheathing press 14, the strand is locked by the sheathing so that it cannot untwist. After the sheathing step, the sheathed cable is usually passed into the cooling device 15 and the primary belt drawing device 16, wherefrom it is passed onto the receiving reel. The process stages after the sheathing press may, however, differ from those described above as there are a great variety of different cables with different production stages.

The embodiments described above are by no means intended to restrict the invention, but the invention can be modified freely within the scope of the claims. Accordingly, it is evident that the arrangement according to the invention or its details need not necessary be such as shown in the figures but other solutions are possible as well. For instance, the separator pin may be replaced by any suitable member. Conical surfaces may be used in certain cases. The capstans can, of course, be rotated by any suitable power supply means. The capstans may also be rotated by a common power supply means, etc.

I claim:

1. In a reverse stranding machine for reverse stranding elongated elements for a cable drawn from supplies thereof through (i) divider means, (ii) torsion tubes peripherally surrounding a central element and periodically rotatable in opposite directions about the central element, and (iii) a twisting head rotatable in opposite directions, into a nozzle to form a stranded cable, a method of achieving substantially constant pitch and adjusting tension, comprising the steps of:

guiding the elements to pass about an input capstan located before the divider means;

passing the elements through the torsion tubes to the nozzle for stranding to form the cable;

passing the stranded cable about an output capstan immediately after the nozzle; and rotating the input capstan and the output capstan so that the peripheral speeds thereof are constantly higher than the speed of the elements or cable.

2. A method according to claim 1 including rotating the input capstan so that the peripheral speed thereof is substantially 20 to 40% higher than that of the peripheral speed of the output capstan.

3. A method according to claim 1 including rotating the output capstan so that the peripheral speed thereof is at least 100% higher than the speed of the cable passing about said capstan.

4. A method according to claim 1 including causing a large difference instantaneously between the peripheral speed of the output capstan and the speed of the cable passing about said output capstan.

5. A method according to claim 4 including effecting said difference by stopping the output capstan for very shod periods of time, on the order of a few milliseconds.

6. A method according to claim 4 including effecting said difference by accelerating the output capstan for a very short period of time, on the order of a few milliseconds.

7. A method according to claim 1 including adjusting a constant braking force on the stranded cable by varying the distance between the twisting head and the nozzle.

8. A method according to claim 1 including adjusting a difference between the peripheral speed of the output capstan and the speed of the cable passing about said output capstan in accordance with the twisting angle of the torsion tubes so that said difference increases with increasing twisting angle.

9. A method according to claim 8 including rotating the output capstan so that the peripheral speed thereof is 20 to 120% higher than the speed of the cable passing about said output capstan.

10. Reverse stranding apparatus comprising:

a divider at an inlet end for receiving elongated elements;

a twisting head rotatable in opposite directions at an outlet end for twisting the elements and forming a stranded cable;

a central element between said divider and said twisting head;

torsion tubes periodically rotatable in opposite directions and peripherally surrounding said central element;

a nozzle cooperable with the twisting head for passing elongated elements received from said divider, said torsion tubes and said twisting head;

an input capstan positioned before said divider and about which the elements are arranged to pass; and an output capstan positioned immediately after said nozzle and about which the stranded elements are arranged to pass, said input capstan and said output capstan being rotatable at peripheral speeds higher than the speed of the elements or cable.

11. Apparatus according to claim 10 wherein the peripheral speed of said input capstan is set 20 to 40% higher than the peripheral speed of said output capstan.

12. Apparatus according to claim 10 wherein the peripheral speed of said output capstan is set at least 100% higher than the speed of the elements or cable passing about said output capstan.

13. Apparatus according to claim 10 including means for varying the distance between the twisting head and the nozzle positioned between the twisting head and the nozzle thereby adjusting a constant braking force exerted on the stranded cable.

14. Apparatus according to claim 10 wherein the peripheral speed of said output capstan is 20 to 120% higher than the speed of the stranded cable passing about said output capstan.

* * * * *